United States Patent [19]

Levander et al.

[11] Patent Number: 5,052,323

[45] Date of Patent: Oct. 1, 1991

[54] BARGE TRANSPORT SYSTEM

[75] Inventors: Kai Levander, Kauniainen; Tuomas Routa; Jan Kingo, both of Helsinki, all of Finland

[73] Assignee: Masa-Yards Oy, Helsinki, Finland

[21] Appl. No.: 581,087

[22] Filed: Sep. 11, 1990

Related U.S. Application Data

[63] Continuation of Ser. No. 366,287, Jun. 13, 1989, abandoned, which is a continuation of Ser. No. 755,206, Jul. 12, 1985, abandoned, which is a continuation of Ser. No. 545,620, Oct. 26, 1983, abandoned.

[30] Foreign Application Priority Data

Nov. 9, 1982 [FI] Finland ..... 823849

[51] Int. Cl.[5] ..... B63B 35/70

[52] U.S. Cl. ..... 114/248; 114/249

[58] Field of Search ..... 114/248, 249, 250, 251, 114/252

[56] References Cited

U.S. PATENT DOCUMENTS

| | | | |
|---|---|---|---|
| 3,345,970 | 10/1967 | De Long | 114/248 |
| 3,557,742 | 1/1971 | Gainsley | 114/248 |
| 3,735,722 | 5/1973 | Hooper et al. | 114/248 |
| 3,815,539 | 6/1974 | Stevens | 114/248 |
| 3,844,245 | 10/1974 | Yamaguchi | 114/248 |
| 3,910,219 | 10/1975 | Ono et al. | 114/248 |
| 3,962,983 | 6/1976 | Ono | 114/248 |
| 4,048,941 | 9/1977 | Legnos | 114/248 |

FOREIGN PATENT DOCUMENTS

| | | | |
|---|---|---|---|
| 131296 | 10/1975 | Japan . | |
| 66693 | 6/1976 | Japan . | |
| 747767 | 7/1980 | U.S.S.R. | 114/249 |

*Primary Examiner*—Sherman Basinger
*Assistant Examiner*—Thomas J. Brahan
*Attorney, Agent, or Firm*—Dellett, Smith-Hill and Bedell

[57] ABSTRACT

A barge transport system comprises one or several barges and at least one powered push vessel connectable to each of said barges for the transport thereof by pushing. The push vessel as well as each of the barges are provided with means for connecting the push vessel rigidly to a selected barge. The connecting means comprise connection members in the front portion of the push vessel as well as in its stern portion. The connection members in the stern portion of the push vessel are movable in the transverse direction of the push vessel into a mechanically positively locking connection position. The connection members and their counterparts are formed to exert a wedge effect on the connection, thereby minimizing any movement inducing connection clearance between the push vessel and the associated barge.

8 Claims, 3 Drawing Sheets

Figure 4:
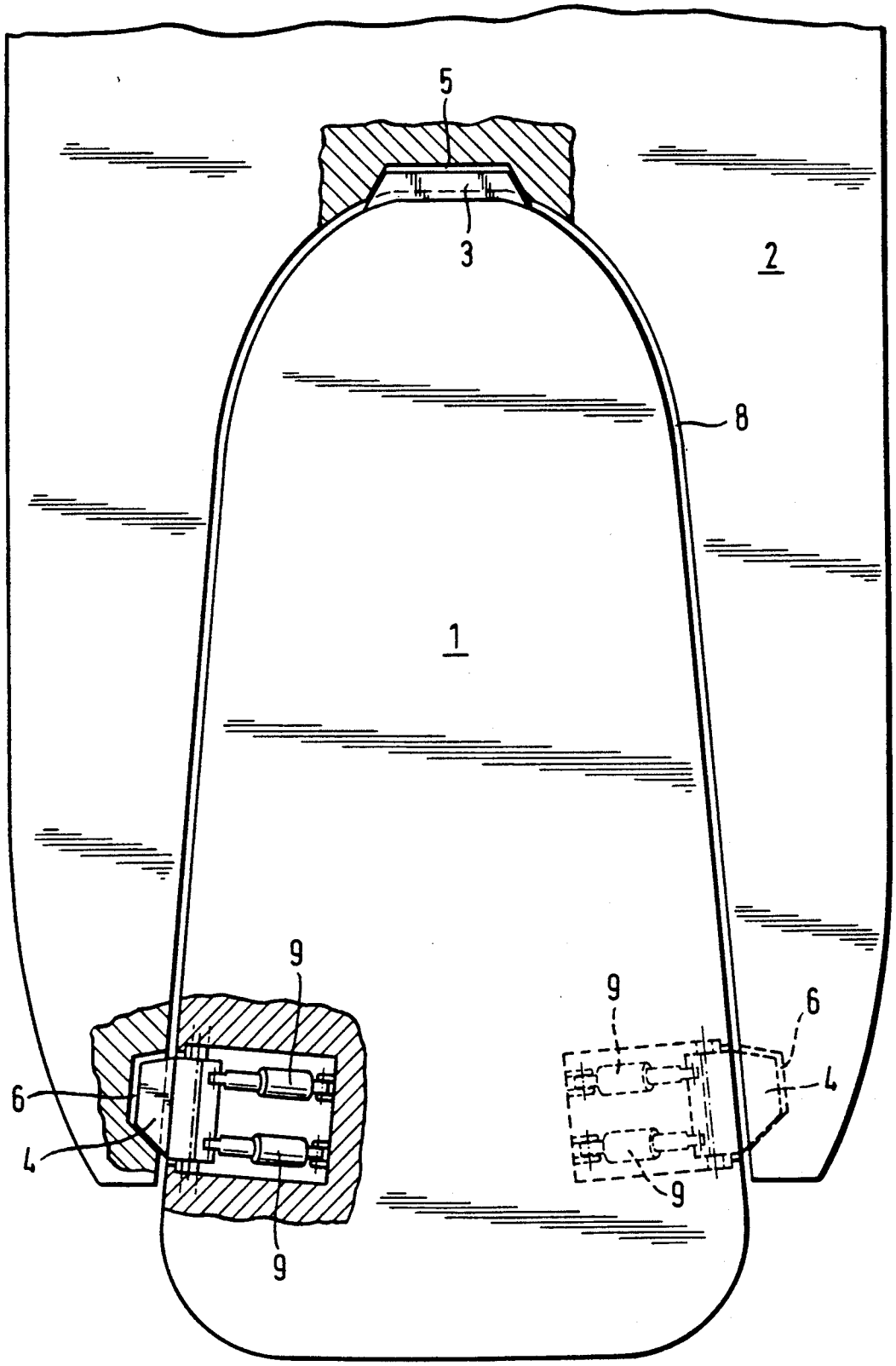

Fig. 1
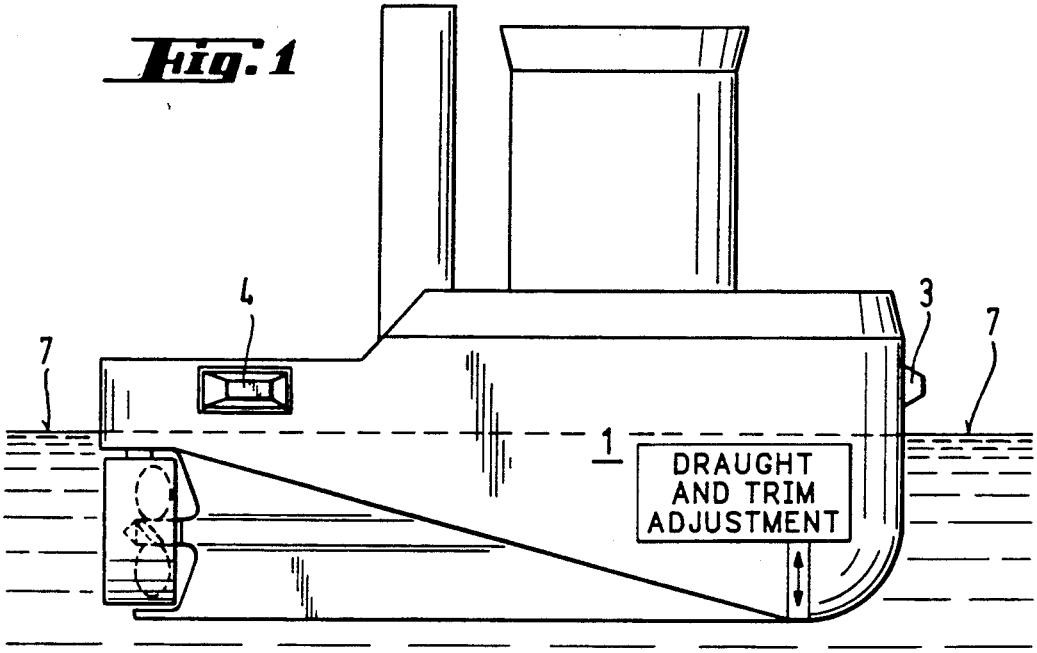
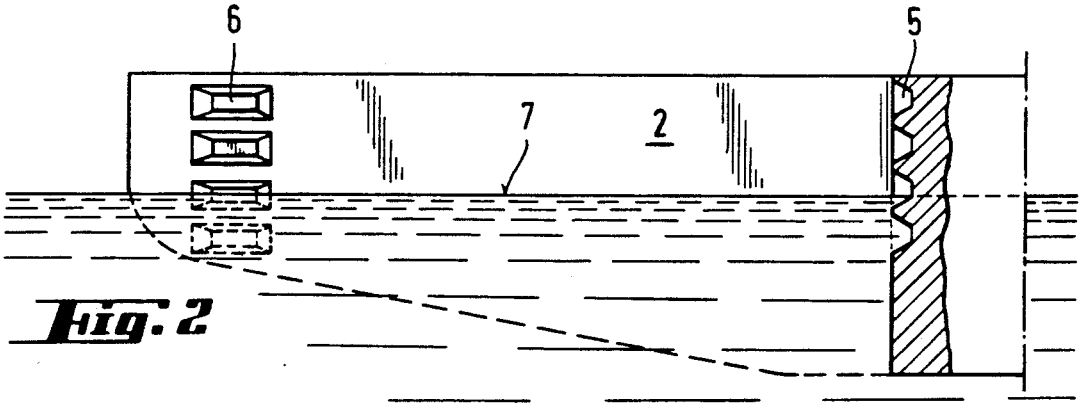
Fig. 2
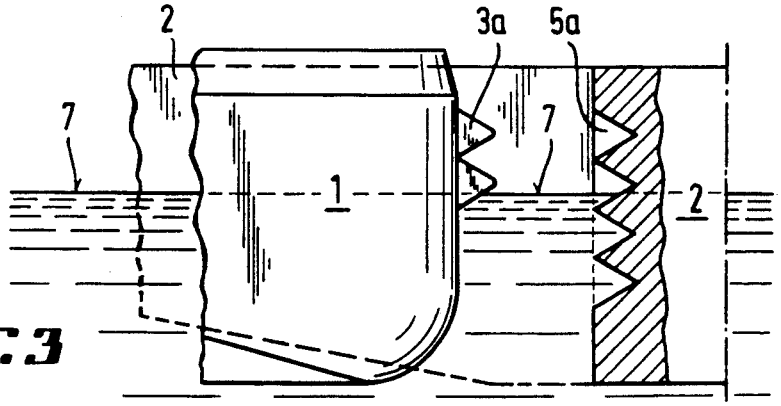
Fig. 3

Fig. 5
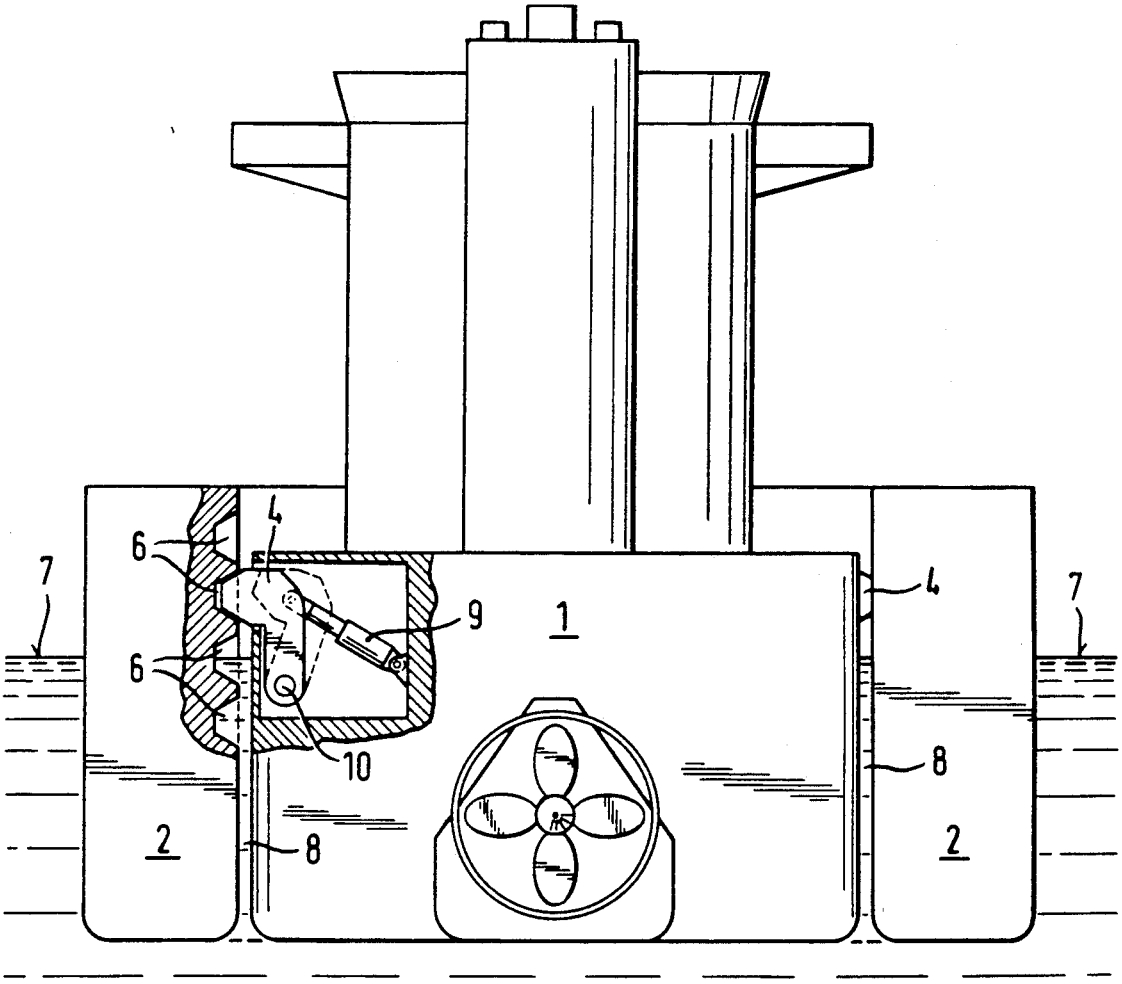
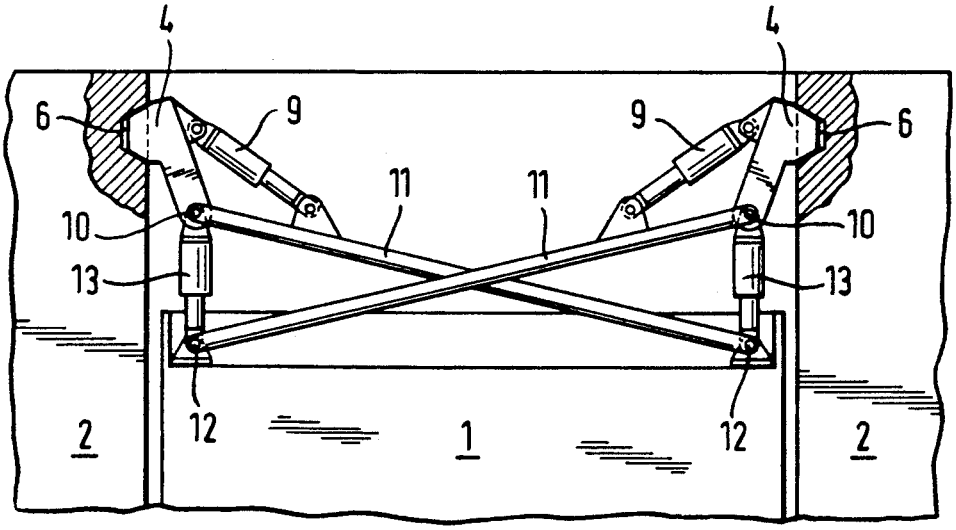
Fig 6

BARGE TRANSPORT SYSTEM

This is a continuation of application Ser. No. 07/366,287 filed June 13, 1989 and now abandoned, which is a continuation of copending application Ser. No. 06/755,206 filed July 12, 1985, now abandoned, which is a continuation of copending application Ser. No. 06/545,620 filed Oct. 26, 1983, now abandoned.

The invention relates to a barge transport system comprising one or several barges and at least one powered push vessel connectable to the barge or each of the barges for the transport thereof by pushing. The push vessel as well as each barge are provided with means for connecting the push vessel rigidly to any selected barge.

Several different barge transport systems are known including a push vessel connectable to the stern portion of a number of barges. The connection between the push vessel and the barge gives rise to problems, firstly, because the floating level of the barge varies according to its load and secondly because open sea conditions require an extremely rigid connetion. Attempts to solve these problems have been made based on the use of different vertically adjustable connection devices. Both friction and mechanical clutch devices have been used to provide locking between the push vessel and the barge. Also longitudinal slide members and cable or chain attachments have also been used. Friction locking is generally not seaworthy. Connection means comprising long slide surfaces can neither be connected nor disconnected in rough water. Other known connection means are so complicated or bulky, that their use is impractical.

The object of the invention is to solve the problem of connecting firmly a push vessel to a barge in a simple manner applicable and reliable also in open sea.

According to the present invention there is provided a barge transport system comprising at least one barge and at least one powered push vessel connectable to said barge for propelling the barge by pushing, said push vessel and said barge being provided with means for connecting the push vessel to the barge, said connecting means comprising at least one connecting member in the front portion of the push vessel, at least two connecting members in the stern portion of the push vessel at opposite respective sides thereof, counterpart means in the barge for engagement by the connecting members, and means for moving the two connecting members in the stern portion of the push vessel into a mechanically positive locking relationship with the counterpart means, said connecting members and the counterpart means therefor being formed to exert a wedge effect when the two connecting members in the stern portion of the push vessel are so moved, thereby minimizing connection clearance between the push vessel and the barge.

In an embodiment of the invention the push vessel is completely firmly connected to the barge by using connection means both in the front and in the stern portion of the push vessel, thereby forming a mechanically positively locking connection having a tightening wedge-effect and including adjustment possibilities to meet changes in the floating level of the barge. The expression "stern portion of the push vessel" means a portion of the push vessel being at a distance from the fore end of the push vessel of at least one half, preferably at least ¾ of the length of the push vessel. The expression "mechanically positively locking" means mechanical locking by means of distinct support surfaces, not pure friction locking.

In a preferred embodiment of the invention, the barge comprises a number of wedge-formed depressions or protrusions at different height levels, to which corresponding connection members of the push vessel can be connected for locking the push vessel firmly to the barge. The push vessel may have, at each connection position, a single connection protrusion and the barge corresponding connection depressions so arranged in vertical rows, that the push vessel can be connected to the barge at a desired level. It is preferred that the connection members in the stern portion of the push vessel are arranged to provide mechanical locking and a wedge effect also in the longitudinal direction of the push vessel and the barge. This can be arranged by providing the push vessel with transversely movable wedge-formed connection members having at their rear side a greater wedge angle than at their front side.

Special care has to be taken regarding the strength and the operational reliability in open sea of the movable connection elements used in the push vessel. Connection elements movable by means of slide surfaces are usually not quite reliable in practice. It is preferred to use rotatably journalled connection members. Shaft bearings are easier to protect against moisture and dirt than slide surfaces.

Since the realization of a connection system being infinitely variable in the vertical direction and at the same time mechanically very firm, is complicated, it is recommended to use a connection system having a plurality of fixed vertical connection positions arranged stepwise with a given pitch. In order to be able to always obtain, in spite of the pitch, a quick and reliable connection, it is practical to provide the push vessel with a trim arrangement, by means of which the draught and the trim of the push vessel can be adjusted as known per se. Thereby, the necessary fine adjustment of the vertical position of the push vessel relative to the barge is easy to carry out.

Not only a strong connection between the push vessel and the barge is important, the connection must also be accomplished quickly and securely under difficult conditions. Since the connection is based on mechanical locking, and not on friction locking, the shape of the notch in the barge arranged to receive the push vessel can be made diverging over its total length, or at least substantially its total length in the backwards direction of the barge. Such a shape is considerably more difficult to use in known constructions having parallel slide surfaces in the barge. A diverging shape of the barge notch very essentially facilitates the connection of the push vessel to the barge. The hull of the push vessel is preferably shaped to correspond to the shape of the barge notch. Further, it is preferrd that the length of the notch is at least 80% of the length of the push vessel.

The invention will now be described, by way of example, with reference to the accompanying drawing, in which FIG. 1 is a side view of an embodiment of a push vessel according to the invention, FIG. 2 is a longitudinal section of the push vessel receiving notch at the stern end of a barge, FIG. 3 shows alternative connection means for connecting the bow of a push vessel to a barge, FIG. 4 is a schematical top view of a push vessel connected to a barge, FIG. 5 is a rear view of a push vessel connected to a barge, FIG. 6 shows schematically another embodiment of a vertically adjustable connection device.

In the drawing, 1 refers to a push vessel and 2 to a barge. The bow of the push vessel has a wedge-formed connection protrusion 3 and the stern portion of the push vessel has wedge-formed connection members 4 at both sides. Protrusion 3 fits into a corresponding depressions 5 in the barge and connection member 4 into a corresponding depressions 6 in the barge. The water level is indicated by numeral 7. The position of the water level relative to the barge may vary considerably depending on the weight of the cargo carried by the barge. Push vessel 1 is connected to depressions 5 and 6 at a suitable level by means of its connection members 3 and 4, respectively. If members 3 and 4 do not directly enter into a suitable depression, the connection can be assisted by using a trim system provided in the push vessel for adjusting its draught and trim position. Trim systems of this kind are well known. They usually comprise water tanks which are filled or emptied for changing the location of the center of gravity of the vessel and/or the weight of the vessel.

An alternative method for the connection at the bow of the push vessel is shown in FIG. 3. In this embodiment, connection depressions 5*a* in barge 2 are arranged in close relationship. There are correspondingly shaped connection members 3*a* in the bow of the push vessel. A greater number of connection members 3*a* provides a better connection grip. By means of the push vessel's own thrust force or any other longitudinal connection force system provided, connection protrusions 3*a* are forced to penetrate in a self-adjusting manner into a suitable connection depressions 5*a*, without any need of using a trim system of the push vessel. The principle shown in FIG. 3 can also be applied, but is less favourable with respect to the connection members in the stern portion of the push vessel and the corresponding connection surfaces of the barge.

FIG. 4 shows how connection protrusion 3 in the bow of the push vessel provides support and a wedge effect also in the transverse direction of the vessel. Connection members 4 in the stern portion of the push vessel are movable in the tranverse direction, whereby they exert a wedge effect and lock push vessel 1 to barge 2 in a longitudinal direction as well. By this means an extremely firm connection between the push vessel and the barge is achieved and both units form together a rigid seaworthy unity. The connection of the push vessel to the barge is essentially facilitated by having a small clearance 8 between them where there are no connection members. Further, the push vessel and the corresponding notch in the stern end of the barge both have a backwards diverging form over the total length of the notch, as shown in FIG. 4.

FIG. 4 also shows that the width of the notch is greater than the width of any portion of the push vessel that could contact the sides of the notch when the push vessel enters the notch.

The swingable connection members 4 in the stern portion of push vessel 1 are powered by means of hydraulic cylinders 9. FIG. 5 shows how members 4 swing on a fixed shaft 10. Each connection member 4 is provided with two hydraulic power cylinders 9 to obtain a high connection force. When the push vessel is connected to the barge, a hydraulic pressure is continuously maintained in the power cylinders. Thereby continuously eliminating all connection clearances that could give rise to undesired movement between the push vessel and the barge. The retracted position of connection members 4 is shown in FIG. 5 by dashed lines.

The push vessel 1 has a central plane about which its hull is substantially symmetrical, and the connection devices in the stern portion of push vessel 1 are symmetrically arranged at with respect to this central plane. When the connection members 4 are moved between their retracted positions and their projecting positions, they move substantially perpendicular to this plane. Since the extension downwards of the back portion of barge 2, as shown in FIG. 2, is relatively small at the position of connection openings 6, it is of advantage to have the corresponding connection members of the push vessel at a relatively high level. For this reason the connection head of each connection member 4 is at a higher level than the fixed shaft of the connection member.

It is also possible to make the connection device of the stern portion of the push vessel vertically adjustable. Then there is no need for a plurality of connection depressions 6 in the barge. Only one at each side is sufficient. FIG. 6 shows schematically how such a vertically adjustable connection device could be constructed. Only the principle of the construction is shown, by no means its proper dimensioning. As in FIG. 5, swingable connection members 4 are journalled on a shaft 10 and their swinging motion is provided by hydraulic power cylinders 9. The shafts 10 and the cylinders 9 are attached to the ends of support beams 11, the opposite ends of which are swingably journalled at a fixed point 12 in the push vessel. Second power cylinders 13 are connected to raise and lower the movable ends of support beams 11, whereby the connection level of connection members 4 is adjusted.

The invention is not limited to the embodiments shown, but several modifications thereof are feasible within the scope of the attached claims.

We claim:

1. An improved sea-going barge transport system comprising a barge and a powered push vessel connectable to the barge for propelling it by pushing, the barge having a stern portion and being formed in its stern portion with a notch extending vertically entirely through the stern portion to allow free vertical positioning of the push vessel relative to the barge, the push vessel and the barge being provided with connection means for rigidly connecting the push vessel to the barge, the connection means forming a three-point connection comprising a forward connecting member in the front portion of the push vessel, two side connecting members in the stern portion of the push vessel at opposite sides thereof, and counterpart structures in the barge for engagement by the connecting members, the forward connecting member forming with the counterpart structure therefor a tapered fitting that defines a final, clearance-free, fully inserted position of the forward connecting member relative to its counterpart structure, and the side connecting members being movable laterally relative to the push vessel to engage their respective counterpart structures, engagement of the connecting members and the counterpart structures locking the push vessel against vertical movement relative to the barge, and the connecting means also comprising means for continuously urging the side connecting members laterally of the push vessel, the improvement residing in the following combination: each side connecting member has a surface that is inclined relative to the central plane of the push vessel whereby a force is exerted that continuously urges the push vessel forward relative to the barge when the two side connecting members are urged laterally of the push vessel against their respective counterpart structures; the forward connecting member is rigidly and immovably connected to the push vessel; and the side connecting members are so sized relative to their counterpart structures and are so positioned relative to their counterpart structures when the forward connecting member is in its final, fully inserted position that continuous urging of the two side connecting members into engagement with their respective counterpart structures urges the push vessel forward relative to the barge, thereby continuously keeping the forward connecting member in its final, clearance-free, fully inserted position and thereby continuously eliminating connection clearance between the push vessel and the barge.

2. A transport system according to claim 1, comprising shafts mounted in the push vessel and on which the side connecting members respectively are swingably journaled for movement into and out of engagement with their respective counterpart structures.

3. A transport system according claim 1, wherein the means for continuously urging the side connecting members laterally of the push vessel comprise hydraulic power cylinders for providing a continuous firm contact pressure between the two side connecting members and their respective counterpart structures.

4. A transport system according to claim 1, wherein the two side connecting members are movable between a retracted position and an ultimate projecting position, and wherein the counterpart structures include means defining side recesses for receiving the side connecting members when the side connecting members are urged toward their ultimate projecting positions, said side connecting members and said side recesses each having upper and lower surfaces that coverage in the direction laterally away from the push vessel.

5. A transport system according to claim 1, wherein the forward connecting member is a wedge-form member that projects forward of the push vessel and the counterpart structures include means defining a recess at the forward end of the notch for receiving the forward connecting member.

6. A transport system according to claim 1, wherein the forward connecting member, the side connecting members and the counterpart structures for the forward and side connecting members form tapered fittings that fix the push vessel against movement relative to the barge when the connecting members engage the respective counterpart structures.

7. A transport system according to claim 1, wherein the length of the notch is at least 80% of the length of the push vessel.

8. A transport system according to claim 1, wherein the notch diverges in the backwards direction over substantially its entire length.

* * * * *